US010661294B2

(12) United States Patent
Brudevold et al.

(10) Patent No.: US 10,661,294 B2
(45) Date of Patent: May 26, 2020

(54) MATERIAL DISPENSE TRACKING AND CONTROL

(71) Applicant: Graco Minnesota Inc., Minneapolis, MN (US)

(72) Inventors: Mark J. Brudevold, Fridley, MN (US); Benjamin R. Godding, St. Cloud, MN (US); Joseph E. Tix, Hastings, MN (US); Daniel P. Ross, Maplewood, MN (US)

(73) Assignee: Graco Minnesota inc., Minneapolis, MN (US)

( * ) Notice: Subject to any disclaimer, the term of this patent is extended or adjusted under 35 U.S.C. 154(b) by 160 days.

(21) Appl. No.: 16/100,777

(22) Filed: Aug. 10, 2018

(65) Prior Publication Data

US 2018/0361415 A1 Dec. 20, 2018

Related U.S. Application Data

(62) Division of application No. 14/679,178, filed on Apr. 6, 2015, now Pat. No. 10,046,351.
(Continued)

(51) Int. Cl.
*B05B 12/12* (2006.01)
*F04B 19/22* (2006.01)
(Continued)

(52) U.S. Cl.
CPC ..... *B05B 12/122* (2013.01); *B05B 7/166* (2013.01); *B05B 7/1693* (2013.01);
(Continued)

(58) Field of Classification Search
None
See application file for complete search history.

(56) References Cited

U.S. PATENT DOCUMENTS 4,827,395 A 5/1989 Anders et al.
5,154,314 A 10/1992 Van Wormer
(Continued)

FOREIGN PATENT DOCUMENTS

CN 1692991 A 11/2005
CN 103537408 A 1/2014
(Continued)

OTHER PUBLICATIONS

First Chinese Office Action dated Sep. 12, 2017, for corresponding Chinese Application No. 201580035594.2.
(Continued)

*Primary Examiner* — Nathan T Leong
(74) *Attorney, Agent, or Firm* — Kinney & Lange, P.A.

(57) ABSTRACT

A method for pumping, tracking, and controlling a fluid includes the steps of producing a drive signal for driving a motor of a pump using a controller, driving the motor to pump a fluid based on the drive signal, sending a dispense signal from the controller to a sprayer for dispensing the fluid, determining a work piece count as a function of a work piece signal provided to the controller from the work piece sensor, detecting the position of a rod connected to the motor and the pump using a position sensor, creating a position signal as a function of the position of the rod using the position sensor, sending the position signal to the controller, and determining a volume usage as a function of the position of the rod using the controller.

18 Claims, 11 Drawing Sheets

Related U.S. Application Data

(60) Provisional application No. 62/024,278, filed on Jul. 14, 2014.

(51) Int. Cl.

| | |
|---|---|
| ***F04B 17/00*** | (2006.01) |
| ***F04B 49/02*** | (2006.01) |
| ***F04B 53/14*** | (2006.01) |
| ***F04B 53/10*** | (2006.01) |
| ***F04B 49/06*** | (2006.01) |
| ***B05B 12/00*** | (2018.01) |
| ***B05B 7/16*** | (2006.01) |
| ***B05B 12/08*** | (2006.01) |
| *B05C 5/00* | (2006.01) |
| *B05C 11/10* | (2006.01) |
| *B05B 9/04* | (2006.01) |

(52) U.S. Cl.

CPC ..... *B05B 12/006* (2013.01); *B05B 12/085* (2013.01); *F04B 17/00* (2013.01); *F04B 19/22* (2013.01); *F04B 49/02* (2013.01); *F04B 49/06* (2013.01); *F04B 49/065* (2013.01); *F04B 53/10* (2013.01); *F04B 53/144* (2013.01); *B05B 9/0409* (2013.01); *B05B 9/0423* (2013.01); *B05C 5/002* (2013.01); *B05C 11/1042* (2013.01); *B05C 11/1044* (2013.01); *F04B 2201/0201* (2013.01); *F04B 2205/09* (2013.01)

(56) References Cited

U.S. PATENT DOCUMENTS

| | | | | |
|---|---|---|---|---|
| 5,801,951 | A | 9/1998 | Burns, II et al. | |
| 5,963,919 | A | 10/1999 | Brinkley et al. | |
| 6,101,427 | A | 8/2000 | Yang | |
| 6,168,387 | B1 | 1/2001 | Able et al. | |
| 6,341,271 | B1 | 1/2002 | Salvo et al. | |
| 6,704,617 | B2 | 3/2004 | Cherfane et al. | |
| 8,255,088 | B2 | 8/2012 | Burkus, II et al. | |
| 8,265,796 | B2 | 9/2012 | Beebe | |
| 8,334,023 | B2 | 12/2012 | Gaon et al. | |
| 8,352,089 | B2 | 1/2013 | Beebe | |
| 2002/0057970 | A1 | 5/2002 | Amslet et al. | |
| 2002/0071772 | A1 | 6/2002 | Isogai et al. | |
| 2004/0089234 | A1 | 5/2004 | Hagglund et al. | |
| 2005/0254879 | A1 | 11/2005 | Gundersen | |
| 2011/0311370 | A1 | 12/2011 | Sloss | |
| 2012/0111884 | A1 | 5/2012 | Choi | |
| 2013/0283917 | A1 | 10/2013 | Coonrod | |
| 2014/0014686 | A1 | 1/2014 | Bacco et al. | |
| 2014/0117047 | A1* | 5/2014 | Ross | F04B 7/02 222/146.2 |
| 2014/0138399 | A1* | 5/2014 | Estelle | F04B 49/00 222/1 |
| 2014/0193277 | A1 | 7/2014 | Mrozek et al. | |
| 2014/0322032 | A1 | 10/2014 | Cedrone et al. | |

FOREIGN PATENT DOCUMENTS

| | | | |
|---|---|---|---|
| CN | 103835931 | A | 6/2014 |
| EP | 2404679 | A1 | 1/2012 |
| EP | 2708288 | A2 | 3/2014 |
| EP | 2732884 | A2 | 5/2014 |

OTHER PUBLICATIONS

Extended European Search Report dated Feb. 12, 2018, for corresponding European Application No. 15821652.3.

International Search Report and Written Opinion dated Jul. 23, 2015, for corresponding PCT Application No. PCT/US2015/025521.

International Preliminary Report on Patentability dated Jan. 17, 2017, for corresponding PCT Application No. PCT/US2015/025521.

* cited by examiner

MATERIAL DISPENSE TRACKING AND CONTROL

CROSS-REFERENCE TO RELATED APPLICATION(S)

This application is a divisional of U.S. application Ser. No. 14/679,178 filed Apr. 6, 2015 for "Material Dispense Tracking and Control" by Mark J. Brudevold, et. al., which in turn claimed the benefit of U.S. Provisional Application No. 62/024,278 filed Jul.14, 2014 for "Material Dispense Tracking and Control" by Mark J. Brudevold, et. al., both of which are hereby incorporated by reference in their entirety.

BACKGROUND

Material dispense systems are systems which dispense a volume of material onto a receiving surface or work piece. Material dispense systems often include a controllable dispenser and a pressure source for pressurizing the material to be dispensed. The material dispensed can be any useful fluid. Commonly dispensed fluids include paints, dyes, glues, and lubricants. Some dispensed fluids, such as glues, must be carefully manipulated into a dispensable form through several processes, such as heating and pumping.

Material dispense systems are often used in automated or manual assembly processes. For example, material dispense systems are used to apply paint to automobiles on assembly lines. Also, material dispense systems are used to apply glue to boxes for packaging on assembly lines. A glue frequently used in packaging material dispense systems is hot melt glue. Hot melt glue must be melted and pressurized before it can be dispensed. Because the melting temperature of the glue is often several hundred degrees Celsius (several hundred degrees Fahrenheit), significant heat is applied to the glue through much of the process. This can lead to burning, or charring, of glue which can clog dispensers and slow down production of packaging materials, such as boxes. Additionally, packaging assembly lines may consume large quantities of glue, making glue a costly raw material.

SUMMARY

In one embodiment, a pump system for pumping a fluid includes a motor housing, a motor, a rod, a positive displacement pump, a position sensor, and a controller. The motor is located within the motor housing. The rod is connected to and driven by the motor, and the positive displacement pump for moving a fluid is driven by the rod. The position sensor produces a rod position signal that is a function of a position of the rod, and the controller produces a drive signal for driving the motor as a function of the rod position signal.

In another embodiment, a system for tracking and controlling a fluid includes a pump system, a work piece sensor, a dispenser, and a controller. The pump system is for pumping the fluid and includes a motor housing, a motor, a rod, and a position sensor. The motor is located within the motor housing. The rod is connected to and driven by the motor and the pump is driven by the rod for moving a fluid. The position sensor produces a rod position signal that is a function of a position of the rod. The controller produces a drive signal for driving the motor as a function of the rod position signal. The work piece sensor produces a work piece signal that is a function of detection of a work piece. And, the dispenser controllably dispenses fluid received from the pump, and the dispenser receives a dispense signal from the controller that is a function of the work piece signal.

In another embodiment, a system for tracking and controlling a fluid includes a pump system, a work piece sensor, a dispenser, and a controller. The pump system is for pumping the fluid, and includes a motor housing, a motor, a rod, and a position sensor. The motor is located within the motor housing. The rod is connected to and driven by the motor and the pump is driven by the rod for moving a fluid. The position sensor produces a rod position signal that is a function of a position of the rod. The dispenser controllably dispenses multiple streams of fluid received from the pump. The work piece sensor produces a work piece signal that is a function of detection of a work piece. The controller produces a drive signal for driving the motor, and produces a dispense signal for the dispenser that is a function of the work piece signal. The controller also determines or calculates a work piece count as a function of the work piece signal, and determines or calculates volume usage as a function of the position signal.

In another embodiment is a method for tracking and controlling a fluid including producing a drive signal for driving a motor of a pump using a controller. The motor is driven to pump a fluid based on the drive signal. A dispense signal is sent from the controller to a sprayer for dispensing the fluid. A determined or calculated work piece count is a function of a work piece signal provided to the controller from the work piece sensor. The position of a rod connected to the motor and the pump is detected using a position sensor. A position signal is created as a function of the position of the rod using the position sensor. The position signal is sent to the controller and a determined or calculated volume is a function of the position of the rod using the controller.

DETAILED DESCRIPTION

Figure 1:
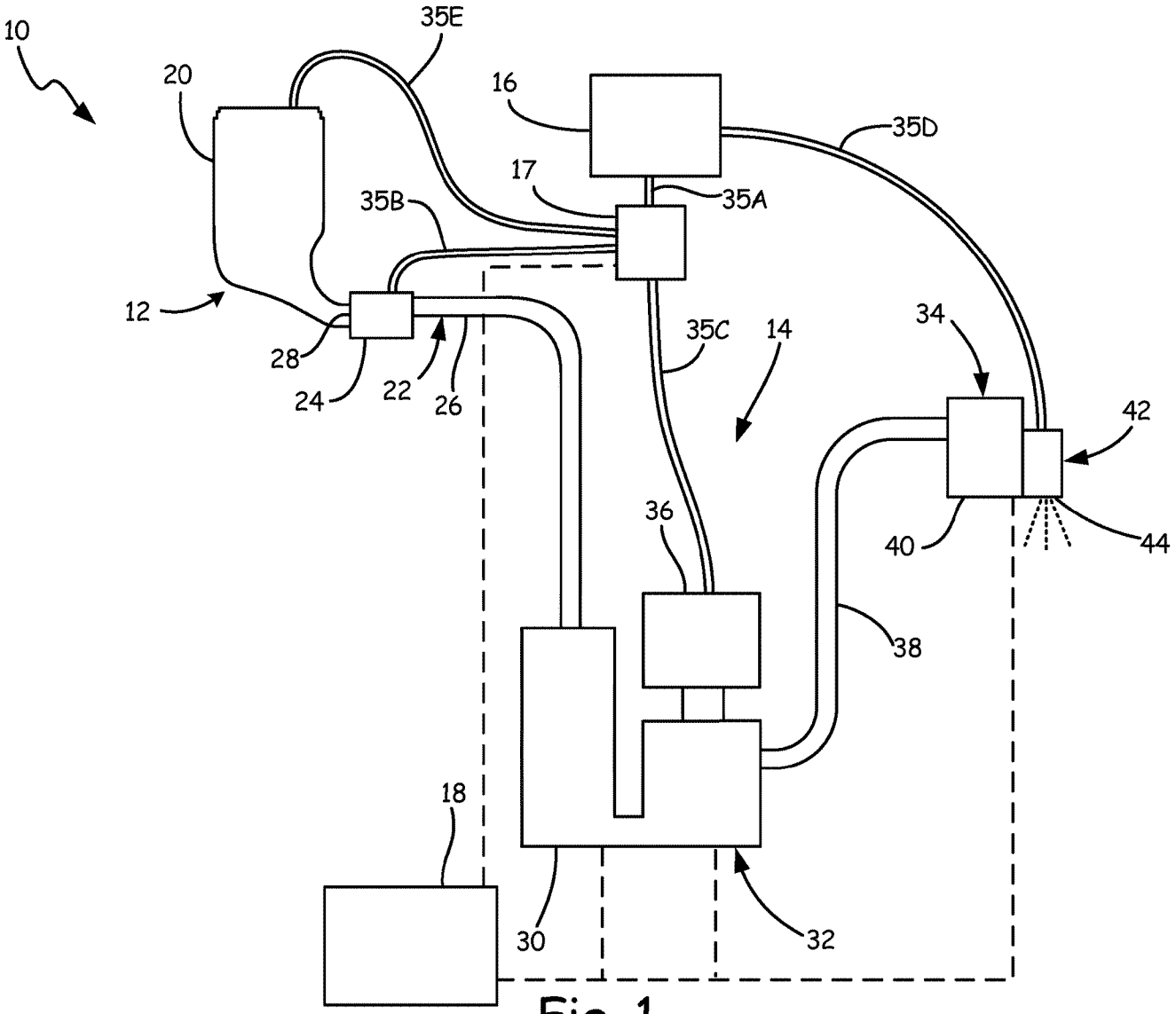
FIG. 1 is a schematic view of a system for dispensing hot melt adhesive.

FIG. 1 is a schematic view of system 10, which is a system for dispensing hot melt adhesive, such as glue. System 10 includes cold section 12, hot section 14, air source 16, air control valve 17, and controller 18. Cold section 12 includes container 20 and feed assembly 22, which includes vacuum assembly 24, feed hose 26, and inlet 28. Hot section 14 includes melt system 30, pump 32, dispenser 34, and supply hose 38. Dispenser 34 includes manifold 40, sprayer 42, and outlet 44. Also included in system 10 are air hoses 35A-35E.

Air control valve 17 is connected to air source 16 by air hose 35A. Air source 16 also connects to dispenser 34 through air hose 35D, bypassing air control valve 17. Air control valve 17 is connected to container 20 by hose 35E. In alternative embodiments, air hose 35E can be connected directly to air source 16, bypassing air control valve 17, or connected to a different air source (not shown) or a different air control valve (not shown). Air control valve 17 is also connected to vacuum assembly 24.

In cold section 12, container 20 connects to vacuum assembly 24 at inlet 28. The outlet of vacuum assembly 24 connects to feed assembly 22. Feed hose 26, of feed assembly 22, connects vacuum assembly 24 to hot section 14. Feed hose 26 connects to hot section 14 at the inlet of melt system 30. Within hot section 14, melt system 30 connects to pump 32. Pump 32 is mechanically coupled to motor 36, which is an air motor (as discussed below). The outlet of pump 32 is connected to dispenser 34 by supply hose 38. More specifically, supply hose 38 connects to dispenser 34 at manifold 40. Manifold 40 connects to sprayer 42. Also connected to sprayer 42 is air hose 35D (which connects to air source 16). The outlet of sprayer 42 is sprayer outlet 44.

Controller 18 is electrically connected with several components of system 10, including air control valve 17, melt system 30, pump 32, and dispenser 34.

Components of cold section 12 can be operated at room temperature, without being heated. Container 20 can be a hopper for containing a quantity of solid adhesive pellets for use by system 10. Suitable adhesives can include, for example, a thermoplastic polymer glue such as ethylene vinyl acetate (EVA) or metallocene.

In one embodiment, air source 16 is a source for delivering compressed air to components of system 10 in both cold section 12 and hot section 14. Air source 16 delivers compressed air to air valve 17, which selectively controls air flow from air source 16 through air hose 35B to vacuum assembly 24 and through air hose 35C to motor 36 of pump 32. Air control valve 17 also delivers bursts of air into container 20 for pressurizing and feeding pellets of adhesive or hot melt into hot system 14.

Compressed air is also transported from air source 16 to air control valve 17 and is delivered to vacuum assembly 24 to create a vacuum. The vacuum created induces flow of adhesive pellets into inlet 28 of vacuum assembly 24 and then through feed hose 26 to hot section 14. Feed hose 26 is a tube or other passage sized with a diameter substantially larger than that of the solid adhesive pellets to allow the solid adhesive pellets to flow freely through feed hose 26. Feed assembly 22 delivers the solid adhesive pellets from container 20 to hot section 14.

Solid adhesive pellets are delivered from feed hose 26 to melt system 30. Melt system 30 can include a container (not shown) and resistive heating elements (not shown) for melting the solid adhesive pellets to form liquid hot melt adhesive. Melt system 30 can be sized to have a relatively small adhesive volume, for example about 0.5 liters, and can be configured to melt solid adhesive pellets in a relatively short period of time.

Pump 32 can be a linear displacement pump driven by motor 36. Motor 36 can be an air motor driven by compressed air from air source 16 and air control valve 17. An additional valve can further control the inlet of compressed air into motor 36, as described below. Pump 32 is driven by motor 36 to pump hot melt adhesive from melt system 30, through supply hose 38, to dispenser 34. Hot melt adhesive from pump 32 is received in manifold 40 and dispensed by sprayer 42 through sprayer outlet 44. Dispenser 34 can selectively discharge hot melt adhesive by spraying out of sprayer outlet 44 of sprayer 42 onto an object, such as a package, a box, or another object for receiving hot melt adhesive dispensed by system 10. Sprayer 42 can be one of multiple modules that are part of dispenser 34, as discussed below. Some or all of the components in hot section 14, including melt system 30, pump 32, supply hose 38, and dispenser 34, can be heated to keep the hot melt adhesive in a liquid state throughout hot section 14 during the dispensing process.

System 10 can be part of an industrial process, for example, for packaging and sealing cardboard packages and/or cases of packages. In alternative embodiments, system 10 can be modified as necessary for a particular industrial process application. For example, in one embodiment (not shown), pump 32 can be separated from melt system 30 and instead attached to dispenser 34. Supply hose 38 can then connect melt system 30 to pump 32.

Controller 18 controls operation of system 10. Controller 18 sends and receives signals from air valve 17, melt system 30, pump 30, and dispenser 34, as described below.

Figure 2:
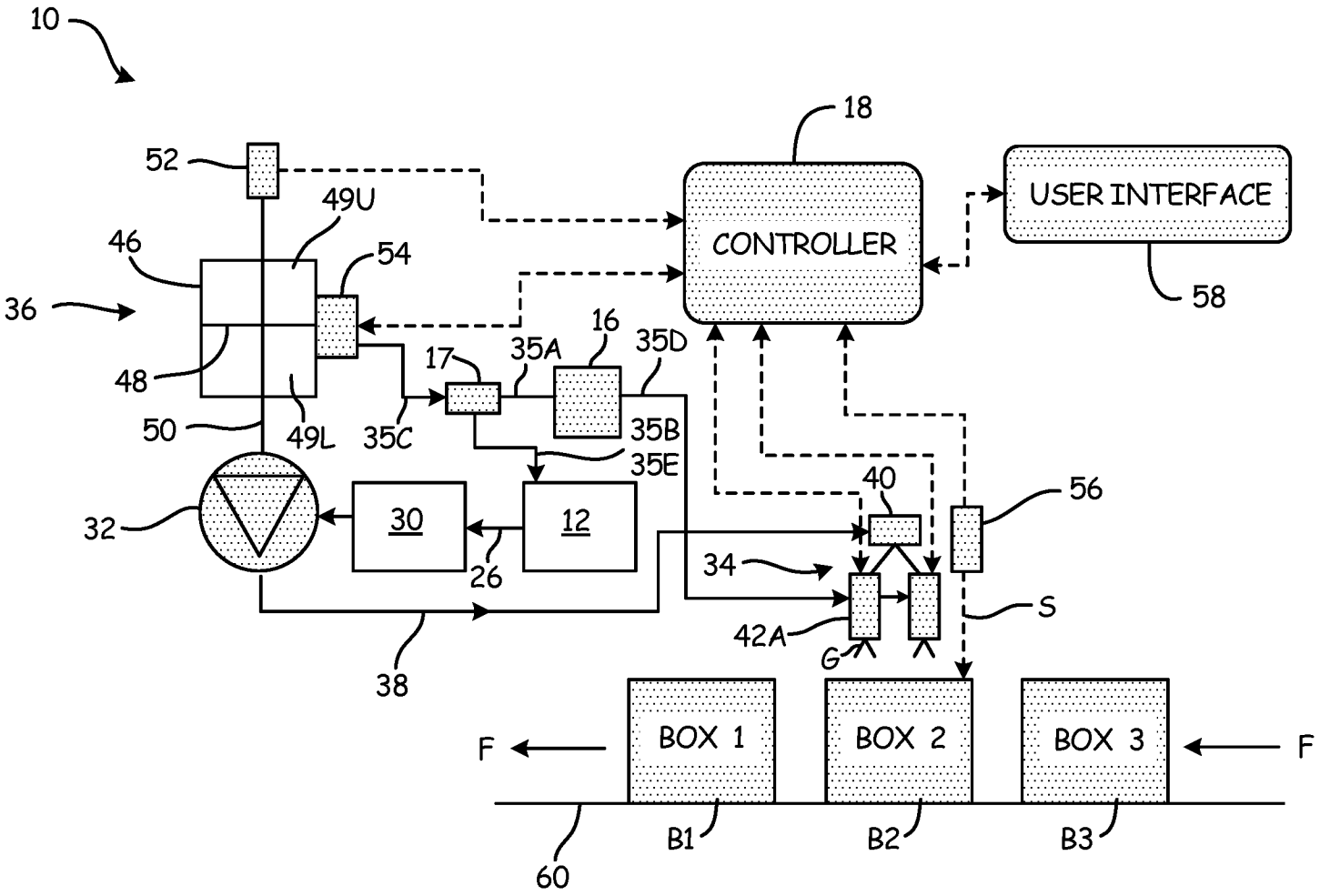
FIG. 2 is a schematic view of the system of FIG. 1.

FIG. 2 is a schematic view of system 10, which includes cold section 12, air source 16, air control valve 17, controller 18, melt system 30, pump 32, dispenser 34, air hoses 35A-35E, air motor 36, and supply hose 38. Dispenser 34 includes manifold 40, sprayers 42*a*-42*n*, and outlet 44. Air motor 36 includes housing 46, air piston 48, upper chamber 49U, lower chamber 49L, rod 50, position sensor 52, and air control valve 54. System 10 also includes box sensor 56, user interface 58, and conveyer 60. Also shown in FIG. 2 are box direction F, glue G, sensor signal S, and boxes B1-B3. Glue G is an adhesive, such as hot melt glue.

The components of system 10 are connected consistently with FIG. 1. However, FIG. 2 further shows user interface 58 electrically connected to controller 18, and box sensor 56 electrically connected to controller 18. FIG. 2 also shows the components of motor 36 in further detail.

Housing 46 of motor 36 defines upper chamber 49U and lower chamber 49L, separated by air piston 48. Upper chamber 49U and lower chamber 49U are physical chambers within motor 46 that contain pressurized air. Upper chamber 49U and lower chamber 49U are separately connected to air control valve 54 through porting (shown in later FIGS.) in motor 36. Air piston 48 is coupled to rod 50, which passes through housing 46. Rod 50 runs through the center of upper chamber 49U, passes through housing 46 at and connects to position sensor 52. Rod 50 also runs through the center of lower chamber 49L and passes through housing 46 and connects to pump 32.

Position sensor 52 is electrically connected to controller 18. Air valve 54 is also electrically connected to controller 18. Also electrically connected to controller 18 is user interface 58. Air valve 54 is also connected to air control valve 17 (shown in FIG. 1). Also, either air valve 54 or air control valve 17 can include a pressure regulator (not shown).

FIG. 2 further details dispenser 34, which includes sprayers 42*a*-42*n*. Each of sprayer 42*a*-42*n* are connected to manifold 40. Sprayers 42*a*-42*n* are also connected to pump 32 by supply hose 38. Sprayers 42*a*-42*n* are further connected, electrically, to controller 18, as is box sensor 56. Both box sensor 56 and sprayers 42*a*-42*n* are located near conveyer 60 in close proximity to boxes B1-B3. Conveyer 60 is a transport system, such as a conveyer system, for moving boxes B1-B3 in the direction of box direction F, through system 10.

Sprayers 42*a*-42*n* are fluid dispensers for applying glue, or another adhesive or fluid, to boxes B1-B3. Sprayers 42*a*-42*n* can be needle type valves, or guns, or other types of dispenser valves. Sprayers 42*a*-42*n* operate like a control valve that is selectively opened and closed based on a dispense signal from controller 18. Sprayers 42*a*-42*n* be individually actuated through dispense signals from controller 18 sent to each of sprayers 42*a*-42*n*, or can be actuated in unison through a dispense single signal sent to all of sprayers 42*a*-42*n*.

In operation of one embodiment, pump 32 is powered by motor 36 to pump glue G from melt system 30, through supply hose 38, to manifold 40, to be distributed to sprayers 42*a*-42*n*. Sprayers 42*a*-42*n* spray glue G, motivated by air pressure from manifold 40, to be applied to boxes B1-B3 moving on conveyer 60. This process is controlled by controller 18 based on inputs received from box sensor 56 and shaft position sensor 52. Controller 18 controls the process by controlling air motor 36 through air control valve 54 and sprayers 42*a*-42*n*.

More specifically, conveyer 60 moves boxes B1-B3 in the direction of box direction F. As boxes B1-B3 travel in box direction F they pass under box sensor 56 and sprayers 42*a*-42*n*. Though boxes B1-B3 are shown, the operation of system 10 also applies to a continuous supply of boxes, as may be common in a boxing operation. Box sensor 56 is a sensor for detecting the presence of a box, such as an electro-optical position sensor or photoelectric sensor, but may be other types of sensors. To detect the presence of a box, box sensor 56 emits a sensor signal S towards the location where boxes pass. For example, when one of boxes B1-B3 cross sensor signal s, box sensor S will detect its presence through lack of a reflected signal, or lack of a received signal. When box sensor 56 detects the presence of one of boxes B1-B3, box sensor 56 sends a box detection signal to controller 18.

Though box sensor 56 is described as detecting boxes, box sensor 56 may detect the presence of any work piece and create a work piece signal for sending to controller 18 based on the detection of a work piece. The box detection signal can also be a work piece signal in an embodiment where work pieces other than boxes are used. After receiving the detection signal from box sensor 56, controller 18 is then aware that one of boxes B1-B3 is under sprayers 42*a*-42*n*. Also, based on the box detection signal, controller 18 can perform a box count, or work piece count, adding up all of the boxes detected and reported to controller 18 by box sensor 56, as described later.

Simultaneously, air motor 36 will power pump 32 to supply glue g to supply hose 38. Air motor 36 is powered by pressurized air that is injected into upper chamber 49U and lower chamber 49L within housing 46, being controlled by air valve 54. For example, as air is injected into upper chamber 49U, piston 48 will move from upper chamber 49U towards lower chamber 49L. When piston 48 reaches the bottom of housing 46, air valve 54 will actuate, forcing pressurized air into lower chamber 49L, reversing the direction of piston 48, sending it from lower chamber 49L towards upper chamber 49U. The movement of piston 48 causes movement of rod 50. Rod 50 activates internal components within pump 32 (described in later FIGS.), which are coupled to pump 32. Because pump 32 is a dual-action type of pump, pump 32 pumps glue G when shaft 50 moves in either direction. This process is described in more detail is later FIGS.

Sensor 52 is a position sensor capable of detecting the position of rod 50, to which sensor 52 is connected. Sensor 52 can be an ultrasonic sensor, an LVDT sensor, a reed switch sensor, or another type of position sensor, as discussed in later FIGS. Pump 32 is a positive displacement pump, or constant volume pump, which means that each full stroke of rod 50 and air piston 48 correlates to a consistent pumped volume of glue G from pump 32. Similarly, partial strokes can correlate to portions of the volume pumped by a full stroke. For example, a half stroke of air piston 48 can equal a half volume of a full stroke pumped by pump 32, depending on the geometry and operation of pump 32. Regardless, the relationship between stroke and volume can be known.

When air motor 36 is in operation, position sensor 52 provides a signal to controller 18 containing positional information regarding rod 50, which allows controller 50 to determine the relative position of rod 50 and therefore the position of piston 48 within air motor 36. Therefore, by detecting the location of rod 50 relative to sensor 52, a pumped volume can be calculated by controller 18 based on a position signal generated by sensor 52. This has several benefits, as discussed below.

When glue G is pumped from pump 32 into supply hose 38, glue G is forced into sprayers 42*a*-42*n*. If sprayers 42*a*-42*n* are open, sprayers 42*a*-42*n* will spray or squirt a stream of glue G onto a surface of a passing box B1-B3. Controller 18 can control sprayers 42*a*-42*n* to open and close in unison, or can control sprayers 42*a*-42*n* to open and close individually. Controller 18 can also control sprayers 42*a*-42*n* to spray a bead of glue G onto boxes B1-B3 in a constant bead or an intermittent bead, or stitch. The length of each stitch and the spacing of the stitches, also known as stitch percentage, can also be controlled by controller 18, through adjustments to sprayers 42*a*-42*n*.

Controller 18 has the ability to adjust the flow rate of fluid output produced by pump 32. Controller 18 can send a drive signal to the pressure regulator within air control valve 54 to adjust the pressure of the air sent to the piston of air valve 54. When the pressure of the air entering air valve 54 is increased, the piston within air valve 54 moves faster. Conversely, when the pressure of the air entering air valve 54 is decreased, the piston moves slower. When the piston moves faster and slower so too does piston 48 and pump 32. By increasing or decreasing the speed of air valve 54 a comparable change in the speed of pump 32 will occur, which will increase or decrease the flow rate of glue G pumped by pump 32. This adjustment of the pressure provided by air valve 54 is often controlled by a voltage regulator controlling the pressure regulator of air valve 54.

As discussed above, position sensor 52 may detect motion of rod 50 allowing for the volume of glue G pumped by pump 32 to be calculated. This calculation can be performed in controller 18 based on a position signal sent from position sensor 52 to controller 18, which contains positional information regarding rod 50. Once controller 18 calculates a volume pumped by pump 32, controller 18 can also perform several additional calculations and system adjustments, as discussed below.

Controller 18 can send any of its calculations or information regarding its calculations or operation of system 10 to user interface 58. User interface 58 can be a local on-site user interface, or human interface, such as a keypad, or may be a remote user interface, such as a computer connected wirelessly or by network cable to controller 18. User interface 58 allows for a user or program to read and download data from controller 18. User interface 58 also allows a user or program to input parameters into controller 18, as described below.

One problem in the prior art is tracking and optimizing glue usage. Many processes use large volumes of adhesives per day. For example, a process in a factory may use one pallet of adhesive per day, which may be 1000-2000 lbs. (455-909 kg) of adhesive. Because the volumes used are so large and the packaging volumes are also large, the usage tracked may not be very granular. For example, a process using one pallet of adhesive per day may only track adhesive or glue usage in units of pallets per day. This is not an accurate unit of measurement when a work piece may use, for example, one ounce (28 g) of glue or adhesive. Therefore, accurate calculations to determine usage per box or work piece and calculations during operation often cannot be performed.

The present disclosure solves these issues by providing the ability to track volumes more accurately. Controller 18 may determine the volume used per work piece or per unit time based on its calculation of a measured volume of glue used. The volume of glue pumped per pump cycle varies depending on the size of the pump. For example, a pump may produce 5 fluid ounces (148 mL) per full cycle of pump piston 124. In an embodiment where each stroke is tracked, controller 18 may determine the volume usage based on increments of 5 fluid ounces (148 mL). However, in embodiments where the position of rod 50 can be detected, such as in FIG. 1, much smaller volume usages may be determined. For example, half strokes, or quarter cycles may be detected, which allow for accuracy of 1.25 fluid ounces (37 mL). Even finer detection and volume usages may be determined by controller 18.

By obtaining information on pumped volumes and flowrates, adhesive usage can be tracked. This allows for process optimization to be performed on system 10, which saves time and money. For example, adjustments to volume output can be input into user interface 58 as described above, which can then be implemented and confirmed by controller 18. These adjustments can allow for output to be more consistent, increasing product quality and efficiency.

Also, in the prior art, these adjustments often need to be made manually and confirmed by observation. The present disclosure saves significant time and energy through these optimizations.

Figure 3:
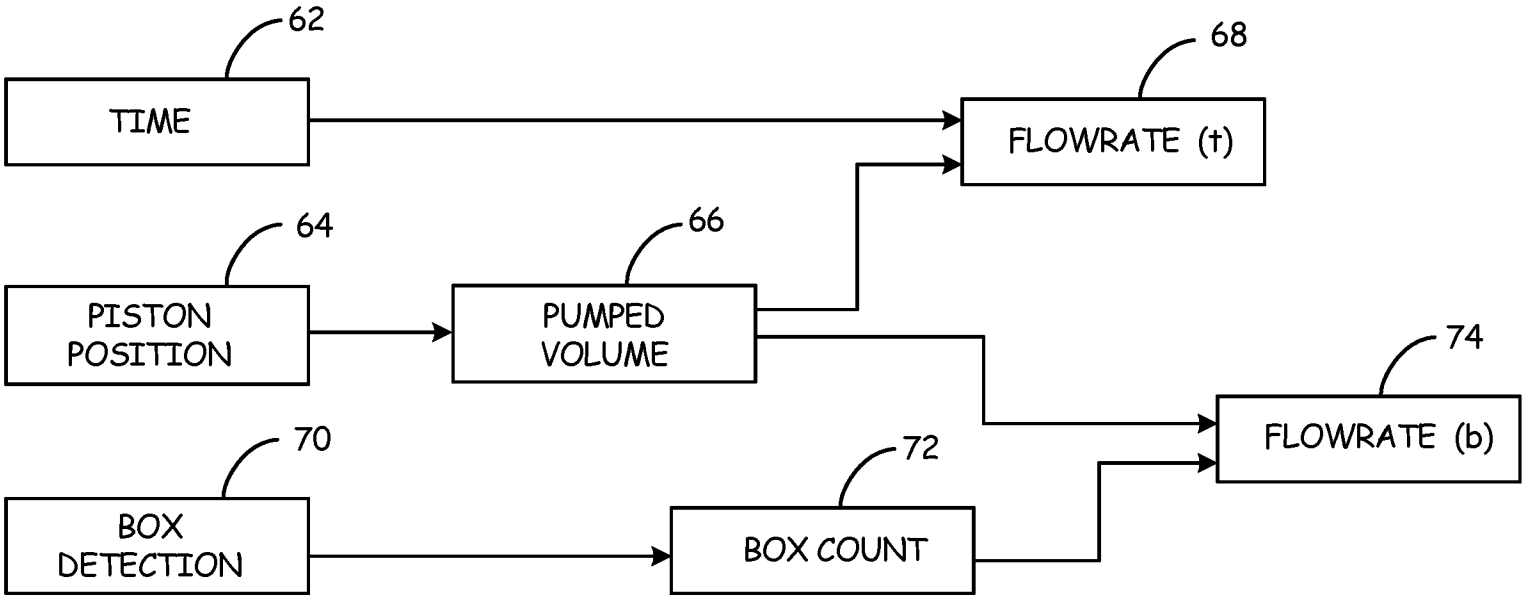
FIG. 3 is a diagram of operations within the control system.

FIG. 3 is a flow diagram of operations within controller 18. FIG. 3 includes Time 62, piston position 64, pumped volume 66, flowrate (t) 68, box detection 70, box count 72, and flowrate (b) 74. Time 62, piston position 64, pumped volume 66, flowrate (t) 68, box detection 70, box count 72, and flowrate (b) 74 are all operations within controller 18.

Controller 18 receives input from position sensor 52 (of FIG. 2), as described above, providing controller 18 with piston position 64 of air piston 48 within air motor 36. Piston position 64 can then be stored in memory within controller 18. Controller 18 can then compare piston position 64 to stored values of piston position 64 to determine if there has been a change. Any change in piston position 64 can be correlated to pumped volume 66 by controller 18. Once pumped volume 66 is obtained, controller 18 can divide pumped volume 66 by a time increment to determine flowrate (t) 68. Time intervals such as seconds, minutes, or hours may be used along with pumped volume 66 in units of fluid ounces, milliliters, or liters to produce flowrate (t) 68 in units of milliliters per second [mL/s], where flowrate (t) 68 is a volumetric flowrate. For example, if 20 milliliters are pumped in 10 seconds, controller 18 may determine that flowrate (t) 68 is 2 [mL/s]. The flow rate may be calculated as a ratio of the total volume pumped over a day divided by a total operation time in a day, giving a long-term flowrate. The flow rate can also be calculated as a ratio of the volume pumped in any given minute or second, resulting in a short-term flowrate.

As discussed above, controller 18 receives a box detection signal from box sensor 56 (shown in FIG. 2). Using this signal, controller 18 determines the presence of a box, producing box detection 70. Controller 18 can store, in memory within controller 18, every instance of box detection 70. Controller 18 can then add up these instances in small or larger quantities to create box count 72. Box count 72 can be simply a count of 1 box or can be a count of many boxes, such as 1,000 boxes. After obtaining box count 72, pumped volume 66 can be divided by box count 72 to produce a volumetric flowrate on a per box basis, flowrate (b) 74. Flowrate (b) 74 can be a volume per box or a volume per, for example 1,000 boxes.

In one embodiment, the flow output of each of dispensers 42*a*-42*n* (of FIG. 1) can be determined based on the flowrate (b) 74 and the dispense signals sent to each of dispensers 42*a*-42*n*. This calculation can also be performed based on flowrate (t) 68.

Figure 4:
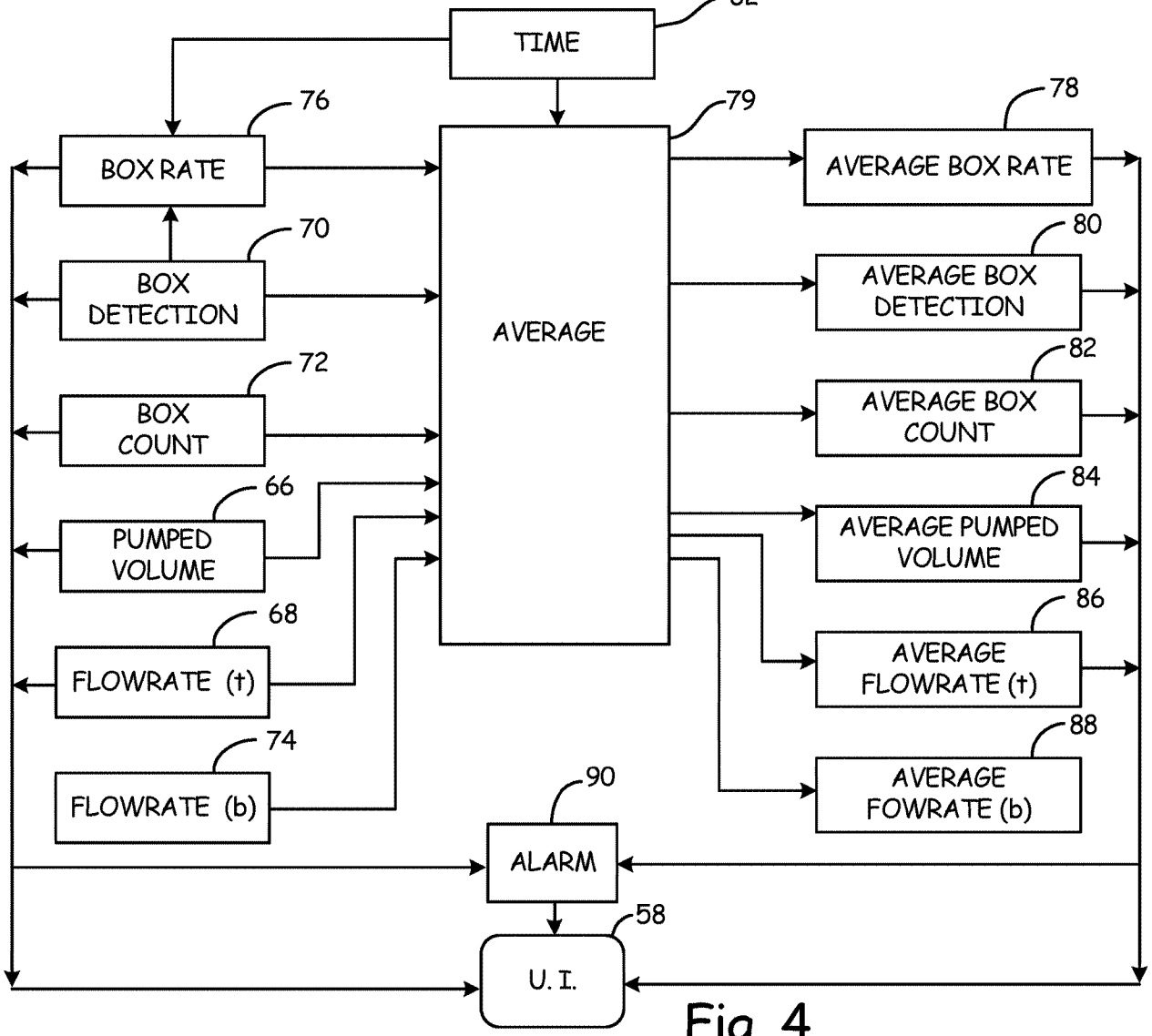
FIG. 4 is a diagram of operations within the control system.

FIG. 4 is a diagram of operations within controller 18. FIG. 4 includes user interface 58, time 62, pumped volume 66, flowrate (t) 68, box detection 70, box count 72, flowrate (b) 74, box rate 76, average box rate 78, average algorithm 79, average box detection 80, average box count 82, average pumped volume 84, average flowrate (t) 86, average flowrate (b) 88, and alarm 90, which are all operations within controller 18.

Based on box detection 70 and time t, controller 18 can calculate box rate 76, which is a rate at which boxes, such as boxes B1-B3 (shown in FIG. 2) pass through system 10. Box rate 76, along with pumped volume 66, flowrate (t) 68, box detection 70, box count 72, and flowrate (b) 74 can be input into average algorithm 79 along with time 62. Average algorithm 79 uses memory within controller 18 to store many values of each of each of pumped volume 66, flowrate (t) 68, box detection 70, box count 72, and flowrate (b) 74, and box rate 76. Average algorithm 79 then can average these values based on a number of stored variables, and over a given time. For example, flowrate (t) 68 can be averaged based on the previous 10 flowrates, or can be averaged based on the number of flowrates in the previous hour of production. Flowrate (t) 68 can also be averaged over the period of a production run or of a day.

In another embodiment, flowrate (b) 74 can be averaged on a per box basis. The volume of fluid per box can be averaged over short and long time durations, for example the volume of fluid per box can be averaged per hour or per minute. Also, the volume per box can be averaged based on short term and long term numbers of boxes. For example, the volume of glue per box can be averaged over the previous 10 or 1000 boxes to have glue applied.

Similarly, average algorithm 79 can average any of pumped volume 66, flowrate (t) 68, box detection 70, box count 72, and flowrate (b) 74, and box rate 76. All of these values can be sent from controller 18 to user interface 58 to be displayed in real time.

Also, alarms can be sent to user interface 58. Alarm 90 receives inputs from pumped volume 66, flowrate (t) 68, box detection 70, box count 72, flowrate (b) 74, box rate 76, average box rate 78, average box detection 80, average box count 82, average pumped volume 84, average flowrate (t) 86, and average flowrate (b) 88. Alarm 90 then compares these values to stored values for each of these inputs and to minimum and maximum values for each input, which can be used to create a prescribed operating range. Alarm 90 can then send an alarm to user interface 58 if any of these inputs goes out of the prescribed range. For example, an alarm may be sent from controller 18 to user interface 58 when the flowrate (t) 68 has changed by a prescribed amount, has fallen under a prescribed minimum flow rate value, or has risen above a prescribed maximum flow rate value. Similarly an alarm may be sent from controller 18 to user interface 58 when the flowrate (b) 74, dispensed per box, has changed by a prescribed amount, has fallen under a prescribed minimum flow rate value, or has risen above a prescribed maximum flow rate value. When alarm 90 determines that any alarm value has been reached, alarm 90 can send a signal to user interface 58 for an alarm to be signaled on user interface 58. The alarm on user interface 58 can be visual, audible, or otherwise.

Similarly, user interface 58 receives inputs from pumped volume 66, flowrate (t) 68, box detection 70, box count 72, flowrate (b) 74, box rate 76, average box rate 78, average box detection 80, average box count 82, average pumped volume 84, average flowrate (t) 86, and average flowrate (b) 88. User interface 58 can display any of these inputs visually, audibly, or in another way.

Figure 5:
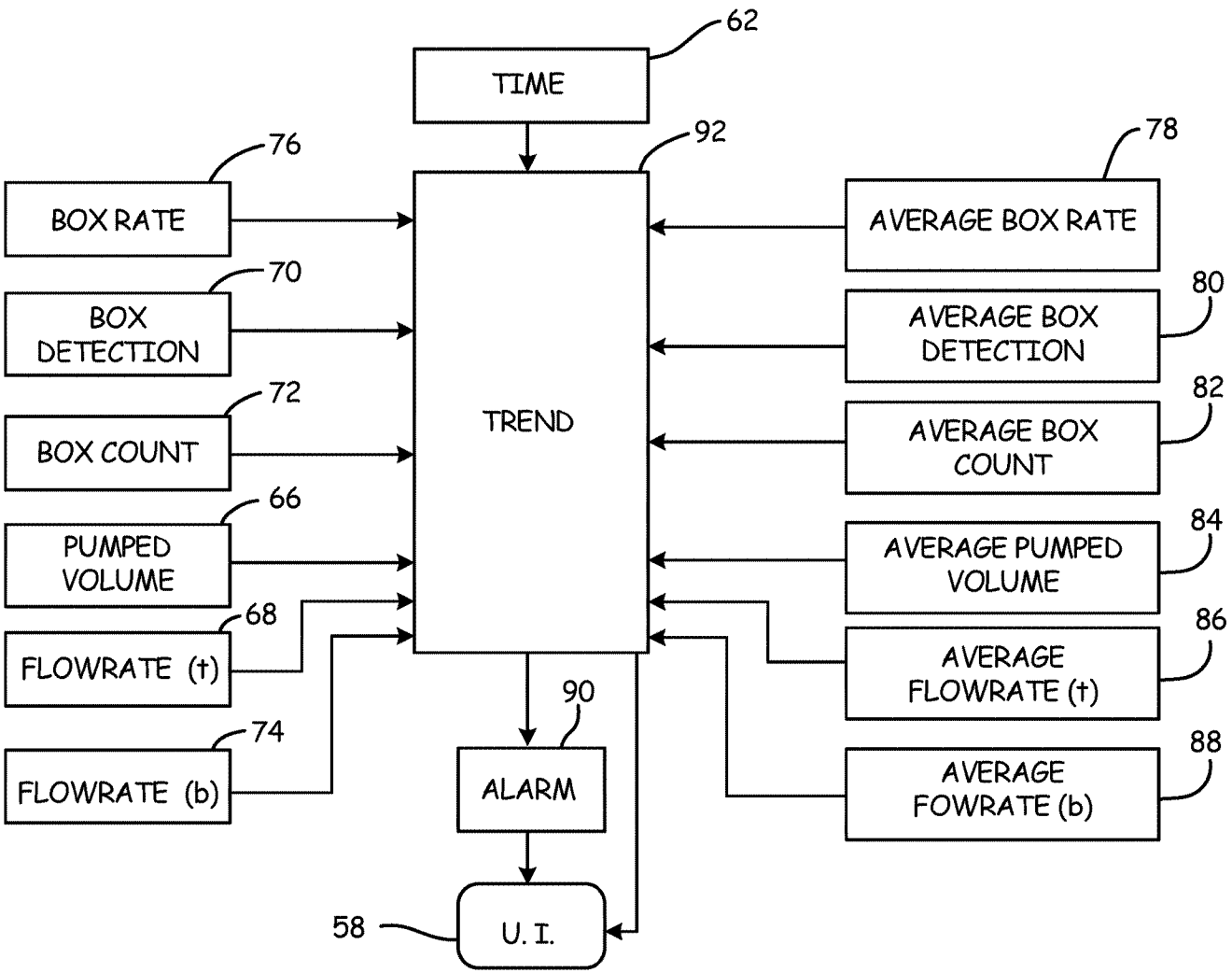
FIG. 5 is a diagram of operations within the control system.

FIG. 5 is a diagram of operations within controller 18. FIG. 5 includes user interface 58, time 62, pumped volume 66, flowrate (t) 68, box detection 70, box count 72, flowrate (b) 74, box rate 76, average box rate 78, average box detection 80, average box count 82, average pumped volume 84, average flowrate (t) 86, average flowrate (b) 88, alarm 90, and trend 92, which are all operations within controller 18.

Time 62, pumped volume 66, flowrate (t) 68, box detection 70, box count 72, flowrate (b) 74, box rate 76, average box rate 78, average box detection 80, average box count 82, average pumped volume 84, average flowrate (t) 86, and average flowrate (b) 88 can all be inputs into trend 92. Controller 18 has the ability to store the results of these inputs in computer readable storage media within controller 18. For example, controller 18 may store all of the values of flowrate (b) 74. Then, trend 92 can create a trend as a function of the stored input data. For example trend 92 can create a trend of average flowrate (t) 86 versus time 62. Trend 92 can also create a trend of any input as a function of another input. For example, trend 92 can create a trend of average flowrate (b) 88 versus box count 72.

Controller 18 can then make these trends available for upload by controller 18 and available for download at user interface 58 to a computer readable storage media within user interface 58, or connected to user interface 58. Trend 92 can also simply send the trends to user interface 58 for display purposes, such as being displayed on a human interface. Further, alarm 90 can output an alarm to user interface 58 if any trends fall outside a predetermined minimum, maximum, or rate of change.

Figure 6:
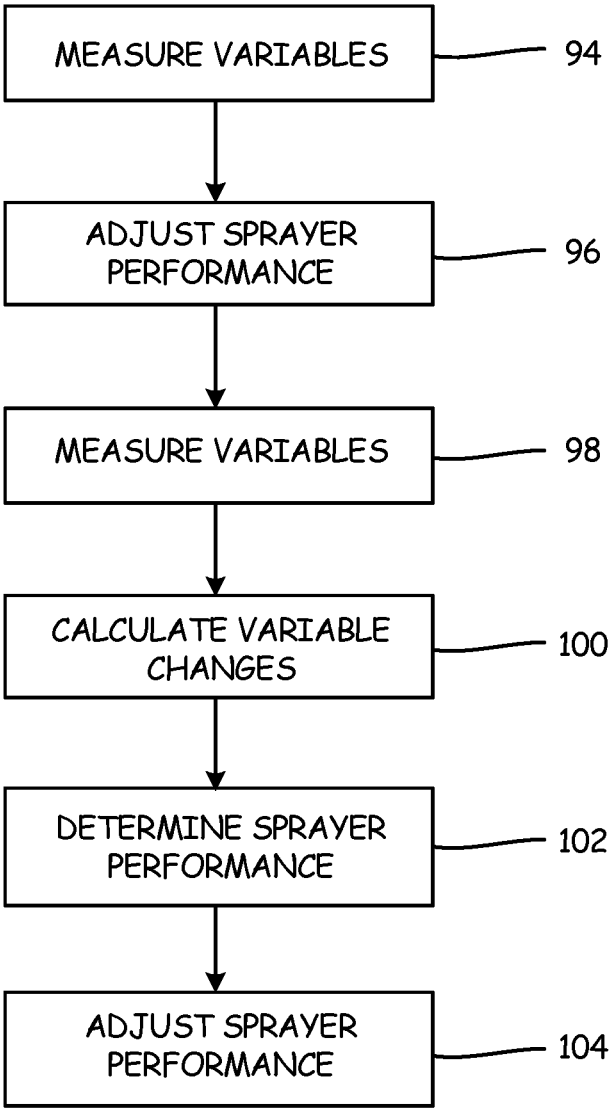
FIG. 6 is a diagram of operations within the control system.

FIG. 6 is a diagram of operations within controller 18. The operations include measure variables 94, adjust prayer performance 96, measure variables 98, calculate variable changes 100, determine sprayer performance 102, and adjust sprayer performance 104.

Controller 18 (shown in FIG. 2) has the ability to send individual signals to sprayers 42*a*-42*n* (shown in FIG. 2), as described above. Using this capability, controller 18 can determine individual sprayer performance. In one embodiment, an array of sprayers includes three sprayers, sprayers 42*a*, 42*b*, and 42*c*, each receiving an independent control signal. In this embodiment, controller 18 can make variable measurement 94 while all three sprayers are operating in unison. Variable measurement 94 can be of any inputs described in the above FIGS., such as time 62, pumped volume 66, flowrate (t) 68, box detection 70, box count 72, flowrate (b) 74, box rate 76, average box rate 78, average 79, average box detection 80, average box count 82, average pumped volume 84, average flowrate (t) 86, average flowrate (b) 88, alarm 90, and trend 92.

Then, controller 18 can perform the step adjust sprayer performance 96 on sprayer 42*a*. The adjustment can be to not dispense at all for one box cycle, can be to change the time that sprayer 42*a* is open, or any other adjustment affecting the output of glue G from sprayer 42*a*. Then, controller 18 can perform the step measure variables 98 during this adjustment to sprayer 42*a*. Most often, controller 18 will measure the same variables in step measure variables 94, and step measure variables 98.

Next, controller 18 can perform the step calculate variable changes 100 by comparing the variables measured in step measure variables 94 and step measure variables 98. For example, controller 18 can compare the volume output for a single box from step measure variables 94 to the volume output for a single box during from step measure variables 98. Further, other calculations may be performed based on the data obtained from these two steps. Based on this comparison, controller 18 can perform the step determine sprayer performance 102. For example, controller 18 can compare flowrate (b) 74 determined at step measure variable 94 to flowrate (b) 74 determined at step measure variable 98. Any change in flowrate (b) 74 allows controller 18 to make a determination of how sprayer 42*a* is performing. Based on the step determine sprayer performance 102, controller 18 can perform the step adjust sprayer performance 104. Continuing the previous example, if controller 18 determines sprayer 42*a* is seriously underperforming, controller 18 may infer that sprayer 42*a* is clogged and turn sprayer 42*a* off. Other adjustments, such as increasing or decreasing flow through sprayer 42*a* may also be performed.

Further, once performance of one or more sprayers is known, Controller 18 may adjust the dispense signals to sprayers 42*a*-42*n* or may adjust the drive signal sent to control pump 32, to adjust output of sprayers 42*a*-42*n*. Also, if sprayer performance is determined to be over or under a predetermined set-point an alarm may be sent to user interface 58.

One problem that exists in the prior art is charring, or burning of glue or adhesive that occurs throughout a dispensing system. This phenomenon is particularly problematic when it results in clogging of a nozzle of a sprayer or an entire sprayer. This disclosure addresses this issue by calculating performance of individual sprayers or dispensers. As discussed above, controller 18 can make adjustments to a sprayer to determine its performance. If the sprayer's performance is lower than expected, or lower than the other sprayers within the dispenser array, controller 18 may determine that a clog exists in the sprayer. Then, an alarm can be sent to user interface 58 to notify a user of a clog. Further, controller 18 can increase the output of the other sprayers in the array of sprayers to compensate for the clogged sprayer. This allows for the process to continue to operate effectively and efficiently until a more convenient or desired time arises to repair the clogged sprayer, for example at the end of a shift, or at the end of a production batch, saving time and cost.

Figure 7:
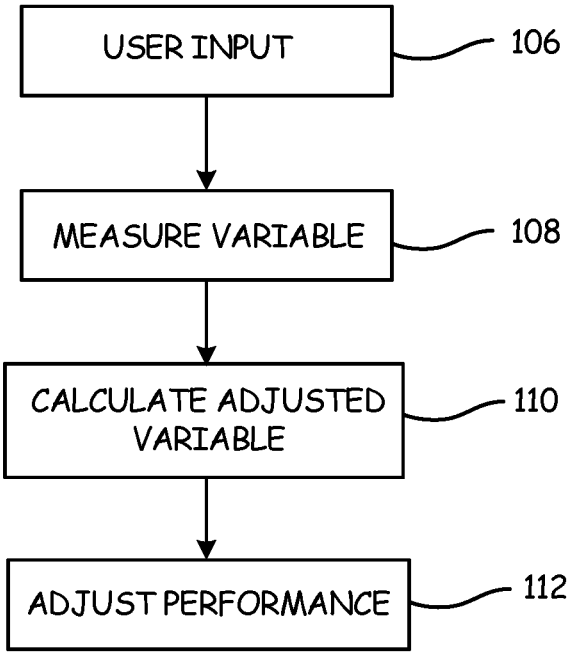
FIG. 7 is a diagram of operations within the control system.

FIG. 7 is a diagram of operations within controller 18. The operations include user input 106, measure variables 108, calculate adjusted variable 110, and adjust performance 112.

In operation of one embodiment, a user performs the step user input 106 and enters input into user interface 58. Controller 18 then can perform the step measure variables 108, where controller 18 measures any of the variables described in the FIGS. above, for example flowrate (b) 74. Based on the data received from the step user input 106 and measure variables 108, controller 18 can perform the step calculate adjusted variable 110, where controller 18 adjusts the variable measured based on data received from user input 106. After adjusting variables, controller 18 can perform the step adjust performance 112, where controller 18 can adjust the performance of any component is system 10 based on the new variable value determined in step calculate adjusted variable 110. This adjustment allows for more accurate calculations to be performed by controller 18.

For example, a user may input a density of glue G being pumped by pump 32. Controller 18 can then calculate the mass or weight of glue G pumped by multiplying the volume pumped by the known density, or m=p*V, where m is mass, p is density, and V is volume.

In another example, the compressibility of the glue or adhesive may also be entered into controller 18 through user interface 58. Similarly, other properties of the glue may be entered into user interface 58 that allows controller 18 to calculate the compressibility of glue G. Knowing the compressibility of glue G allows controller 18 to more accurately determine volume pumped by pump 32 by comparing a measured pressure of glue G downstream of pump 32, or based on a known relationship of pressure applied to glue G based on the reciprocating speed of pump 32 and a known system pressure curve.

Also, a desired dispenser output may be entered into controller 18 through user interface 58. The desired output may be, for example, a desired flowrate (b) 74 output from sprayers 42*a*-42*n*, or a desired flowrate (t) 68. When controller 18 is given a command to control to a desired output, controller 18 may then control air motor 36 (shown in FIG. 2) and sprayers 42*a*-42*n* (shown in FIG. 2) to meet the desired output. For example, glue G can be laid or sprayed on box 1 in a constant bead or an intermittent bead, also referred to as a stitch. In an attempt to control to the desired output, controller 18 can adjust the time sprayers 42*a*-42*n* are open to vary the size of the bead, or the size and quantity of the stitches applied to a given box. Controller 18 can also turn on and off some of sprayers 42*a*-42*n*, or not open them, to increase or decrease the output of sprayers 42*a*-42*n* to meet the desired output.

Also, controller 18 can adjust the signal sent to control the speed of air valve 54, as discussed above, by adjusting the pressure regulator of valve 30. This increases or decreases the flow rate of glue G output by pump 32. This adjustment to pressure and flow rate can be done to meet the desired output of sprayers 42*a*-42*n*.

Figure 8:
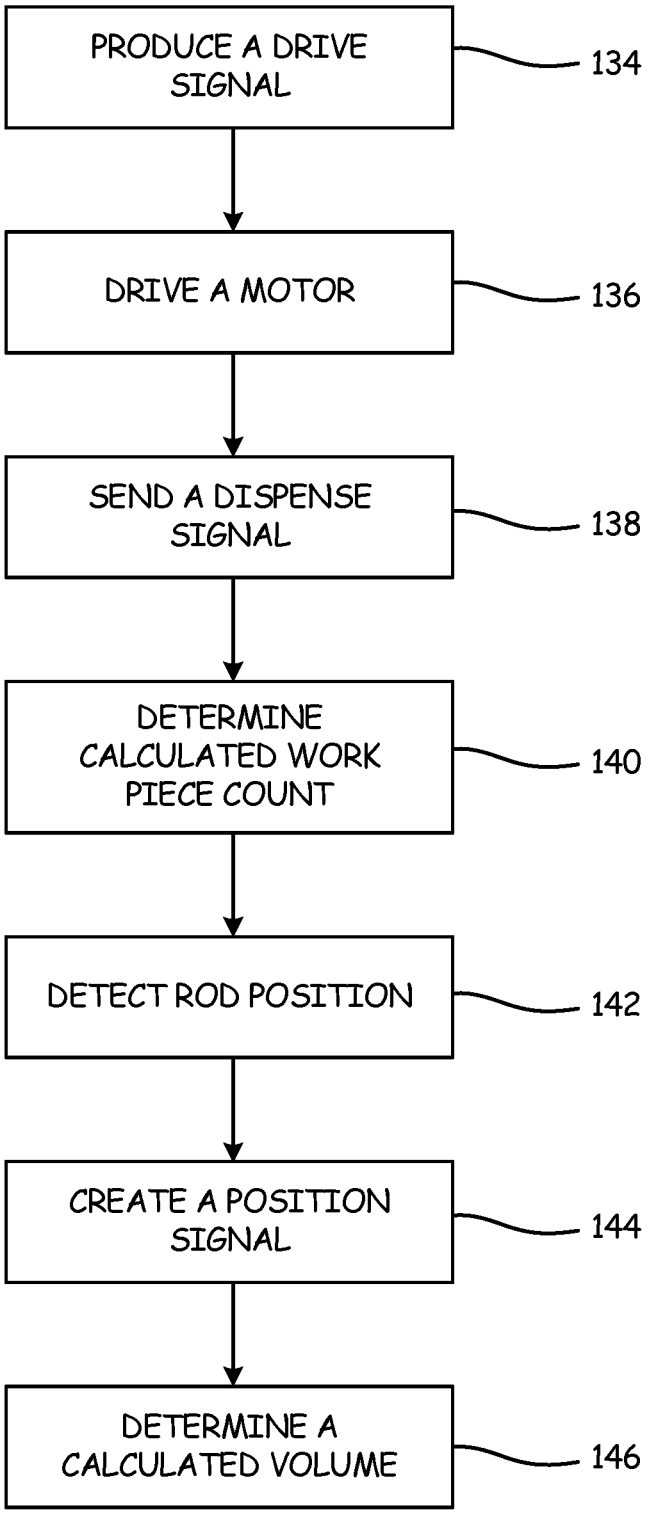
FIG. 8 is a diagram of operations within the control system.

FIG. 8 is a diagram of operations within controller 18. The operations include produce a drive signal 134, drive a motor 136, send a dispense signal 138, determine calculated work piece count 140, detect rod position 142, create a position signal 144, and determine a calculated volume.

As previously discussed, a drive signal can be sent by controller 18 (shown in FIG. 1) to air motor 36 (shown in FIG. 1) to drive pump 32. In one embodiment, controller 18 can perform the step produce a drive signal 134, which results in the step drive motor 136, where air motor 36 is driven. Controller 18 can also perform the step send a dispense signal 138, where a dispense signal is sent to dispenser 34 (of FIG. 1) or sprayers 42*a*-42*n* (of FIG. 2). Controller 18 can also perform the step determine a calculated work piece count 140 as a function of the box detection signal provided by box sensor 56 (shown in FIG. 1). Based on this, controller 18 can perform the steps detect rod position 142 and create a position signal 144. Following these steps, controller 18 can perform the step determine a calculated volume 146.

Figure 9:
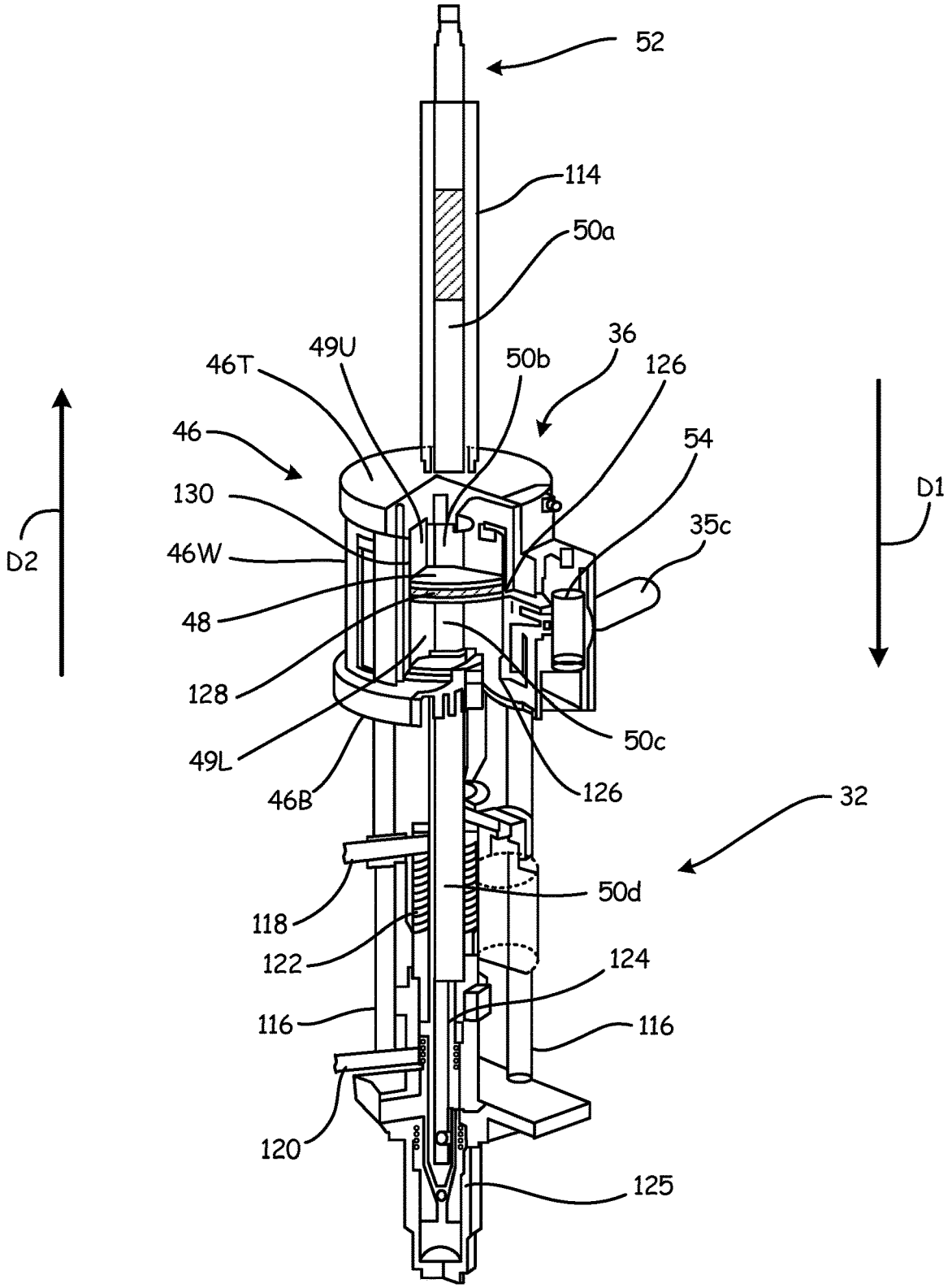
FIG. 9 is a partial cross sectional view of a pump system.

FIG. 9 is a partial cross sectional view of pump 32 and air motor 36 of system 10. FIG. 9 also includes rod sections 50*a*-50*d*, position sensor 52, and sleeve 114. Pump 32 includes rod 50*d*, supports 116, inlet 118, outlet 120, seal 122, pump piston 124, and pump housing 125. Air motor 36 includes, housing 46, air piston 48, upper chamber 49U, lower chamber 49L, rod sections 50*a*-50*c*, air control valve 54, porting 126, seal 128, and air cylinder 130. Housing 46 includes housing top 46T, housing bottom 46B, and housing sidewall 46W. Also shown in FIG. 1 are directions D1 and D2.

Housing 46, including housing top 46T, housing bottom 46*b*, and housing sidewall 46W define air cylinder 130, in which air piston 48 resides. Housing top 46T and housing sidewall 46W of air motor 36 also define upper chamber 49U, and housing bottom 46U and housing sidewall 46W define lower chamber 49L. Upper chamber 49U and lower chamber 49L are separated by piston 48. Upper chamber 49U and lower chamber 49U are physical chambers within motor 46 containing pressurized air, and are separately connected to air control valve 54 through porting 126.

Air motor 36 is connected, structurally, to pump 32 by supports 116. Rod 50, which is a metal cylinder, couples air motor 36 to pump 32. Rod 50 passes through both ends of air motor 36. Air piston 48 is coupled to rod 50*b* in upper chamber 49U and air piston 48 is coupled to rod 50*c* in lower chamber 49L. Rod 50*b* passes through housing top 46T and becomes rod 50*a*, which extends into sleeve 114, which is fastened to motor housing 46. Rod 50*c* passes through housing bottom 46B and becomes rod 50*c*, which connects to pump piston 124 of pump 32.

Also connected to housing 46 is air valve 54. Air valve 54 is also connected to air hose 35*c* (of FIG. 1). Air valve 54 is in fluid communication with both sides of air piston 48 through porting 126. Air valve 54 is also in fluid communication with incoming pressurized air from air control valve 17 through air hose 35*c* (both shown in FIG. 1), and the ambient environment or another relatively low pressure source. Physically, air valve 54 is attached and secured to housing wall 46W.

Air piston 48 is movable within cylinder 130 and is connected to rod 50, which passes through air piston 48. Rod 50 may be a single piece passing through and coupled to air piston 48, or may be multiple pieces fastened together to make a single functional piece. Air piston 48 is cylindrical having an outside diameter approximately equivalent to the inside diameter of housing 46 or cylinder 130. Air piston 48 includes seal 128 attached to the outer diameter of air piston 48 that contacts the wall of cylinder 130 or the inner diameter of housing wall 46W. Air piston 48 is composed of metal but other materials resistant to failure at operating conditions, such as plastics, can be used.

Connected to the outside of housing top 46T of air motor 36 is sleeve 114. Sleeve 114 is predominantly shaped like a hollow cylinder connecting at one end to air motor 36 and the other end to position sensor 52. Sleeve 114 may be composed of plastic or metal, depending on operating conditions. Sleeve 114 is fastened to housing 46 of motor 24 through a fitting, such as a threaded fitting, or other fastening means. Rod 50*a* extends into sleeve 114, but stops short of position sensor 52 at the end of sleeve 114 distal from air motor 36.

Connected to the outside of housing bottom 46B of air motor 36 is pump 32. Air motor 36 connects to pump 32 through supports 116 and rod 50 as described above. Within pump 32, rod 50*d* passes through seal 122 and connects to pump piston 124. Rod 50*d* is coupled or otherwise fastened to pump piston 124. Pump piston 124 is movable within pump 32 and is in fluid communication with inlet 118 and outlet 120.

Pump housing 125 of pump 32 houses the components of pump 32 and also contains the pressure of fluid within pump 32 around fluid piston 124. Further, seal 122 of pump 32 surrounds rod 50*d*, where rod 50*d* enters pump housing 125. Seal 122 prevents the escape of the fluid from pump 32, prevents entrainment of pressurized air into pump 32, and prevents other foreign substances from entering pump 32. Similarly, a seal will be used where rod 50*d* penetrates housing bottom 46B and housing top 46T to prevent pressurized air from escaping from air motor 36, or to prevent the fluid or other foreign substances from entering air motor 36.

Supports 116, which connect pump 32 and air motor 36, are rigid mounts composed of a material, such as metal, to ensure that pump 32 and air motor 36 remain in alignment. Alignment of pump 32 and air motor 36 ensures smooth operation and reciprocation of air piston 48, rod 50, and pump piston 124, which increases efficiency of pump 32, increases life of the components of pump 32, and the accuracy of position sensor 52.

In operation of one embodiment, air valve 54 receives pressurized air from air hose 35*c* and directs pressurized air to a first side of air piston 48 through a first path in porting 126, for example upper chamber 49U. Simultaneously, the second side of air piston 48, for example 49L, will be exposed to a much lower pressure, such as ambient pressure, through a second path in porting 126. This causes air piston 48 to move in a direction from the upper chamber 49U to lower chamber 49L, in direction D1. Motion of air piston 48 in direction D1 causes rod 50 to move in direction D1, which also causes motion of pump piston 124 in direction D1.

Motion of pump piston 124 in direction D1 creates a pumping action, which motivates a fluid, such as glue, paint, or other fluid, to travel from inlet 118 to outlet 120 at a desired pressure and flowrate. When air piston 48 and pump piston 124 reach the end of their stroke, air valve 54 will change direction. This can be accomplished through timing, i.e. air valve 54 can be designed to have a return spring that returns its piston at the same time that air piston 48 reaches the end of its stroke. Changing the direction of the piston within air valve 54 can also be accomplished through controls. An end switch, or multiple end switches, can be used to produce a signal when air piston 48 has reached the end of its stroke. This signal is sent to controller 18, which uses the signal to instruct air valve 54 to reverse its piston.

At this point, air valve 54 will slide or reciprocate to another position, connecting lower chamber 49L with pressurized air, and connecting the upper chamber 49U with ambient pressure, or another low pressure source. This causes air piston 48 to reverse directions and move in direction D2. This causes rod 50 to move in direction D2, which drives pump piston 124 in direction D2. Because pump 32 is a double-action pump, such as a 2-ball or 4-ball double action pump, motion of pump piston 124 in the direction of D2 will also motivate fluid to travel from inlet 118 to outlet 120. In other words, motion of pump piston 124 in either direction D1 or D2 results in the pumping of fluid, or glue G, from inlet 118 to outlet 120.

When air piston 48 moves in direction D1, so does rod 50*a*, which resides in sleeve 114. When rod 50*a* is fully extended into sleeve 114, rod 50 does not extend fully through sleeve 114, but stops short of making contact with position sensor 52 leaving a gap between the end of rod 50 and position sensor 52, which is positionally fixed.

In one embodiment, position sensor 52 is an ultrasonic detector for detecting the position of rod 50. Position sensor 52 does this by sending an ultrasonic pulse down sleeve 114 towards rod 50. When the pulse reaches rod 50 it will reflect back towards position sensor 52. Position sensor 52 then detects the reflected pulse and calculates the distance of rod 50 from position sensor 52 as a function of the difference between the time the pulse was transmitted and the time the reflected pulse was received.

Because pump 32 is a constant displacement pump, each full stroke of rod 50 correlates to a consistent pumped volume from pump 32. Similarly, partial strokes can correlate to portions of the volume pumped by a full stroke. For example, a half stroke of air piston 48 can equal half of the volume of a full stroke of air piston 48, depending on the geometry and operation of pump 32. Regardless, the relationship between stroke and volume can be known. Therefore, by detecting the location of rod 50 relative to position sensor 52, a pumped volume can be calculated. This has several benefits as discussed above.

Figure 10:
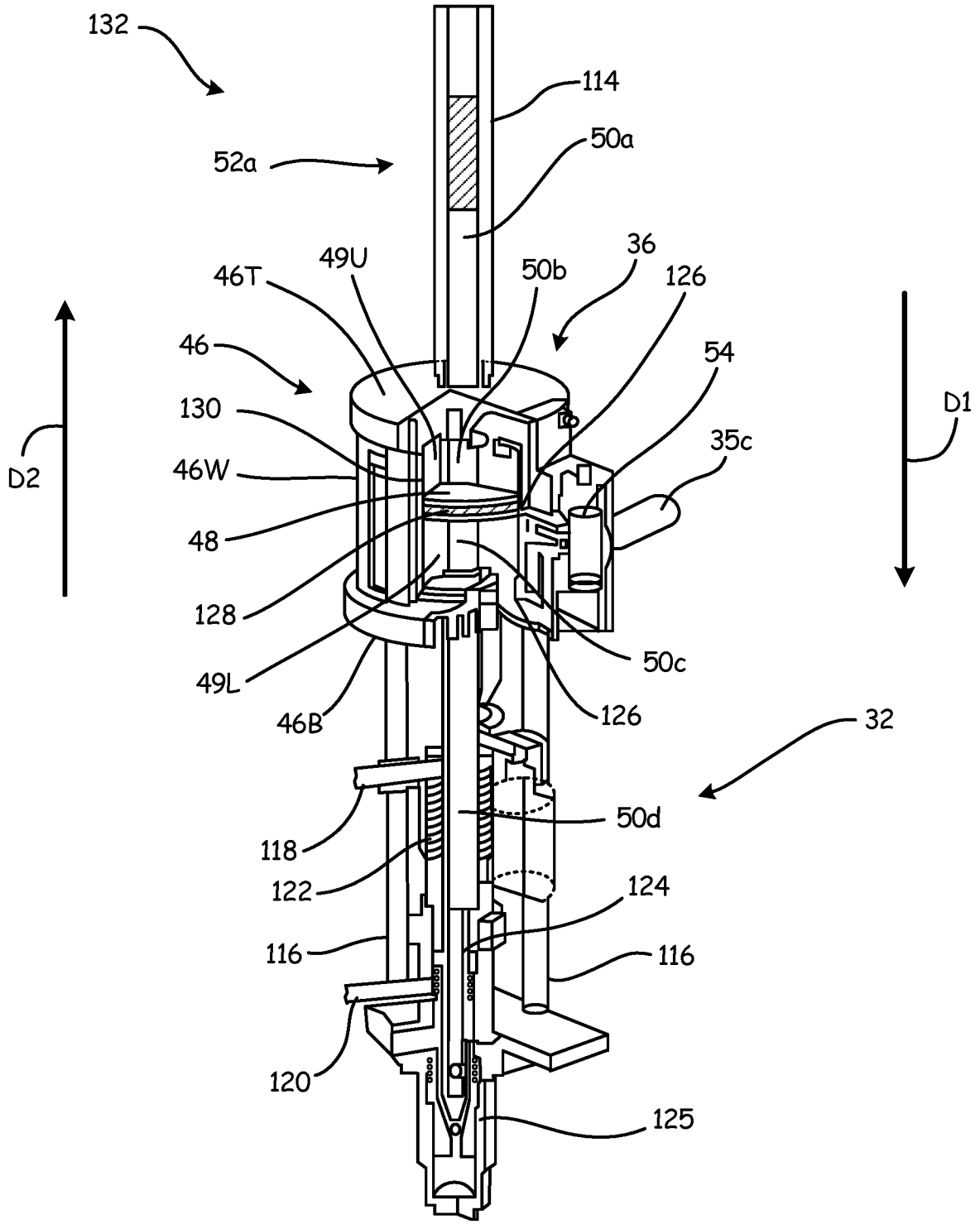
FIG. 10 is a partial cross sectional view of a pump system.

FIG. 10 is a partial cross sectional view of another embodiment of pump 32 and air motor 36*a* of system 10. Elements of FIG. 10 that are similar to elements of FIG. 9 are identified by similar character reference numbers. FIG. 10 also includes position sensor 52*a*, and sleeve 114*a*. Pump 32 includes rod 50*d*, supports 116, inlet 118, outlet 120, seal 122, pump piston 124, and pump housing 125. Air motor 36*a* includes, housing 46, air piston 48, upper chamber 49U, lower chamber 49L, rods 50*a*-50*c*, air control valve 54, porting 126, seal 128, and air cylinder 130. Housing 46 includes housing top 46T, housing bottom 46B, and housing sidewall 46W. Also shown in FIG. 1 are directions D1 and D2.

The components of FIG. 10 are connected similarly to the components of FIG. 9. However, in air motor 36*a*, rod 50*a*, position sensor 52*a*, and sleeve 114*a* form LVDT 132, which is a linear variable differential transformer (LVDT). In one embodiment, sleeve 114*a* contains coils (not pictured) surrounding rod 50*a*. The coils are fixed within sleeve 114*a* and cannot move relative to sleeve 114*a* or air motor 36, as sleeve 114*a* is fastened to housing top 46T.

Rod 50*a* is a ferromagnetic material, such as steel, and reciprocates within sleeve 114*a*, acting as the core of LVDT 123. Position sensor 52*a* contains a processor and circuitry required to determine movement of rod 50*a* within sleeve 114*a*, produce a signal based on the movement of rod 50*a*, and power the coils within sleeve 114*a*.

In operation of one embodiment, one or more primary coils within sleeve 114*a* produce a voltage, which causes a voltage to be induced in the secondary coils of sleeve 114*a* through rod 50*a*. The voltage signals induced in the secondary coils change as rod 50*a* moves relative to the coils within sleeve 114*a*, and are detected by the circuitry and processor of position sensor 52*a*. This allows the position of rod 50*a* to be determined relative to sleeve 114*a*. Therefore, the position of rod 50*a* and air piston 48, which are connected to rod 50*a*, can also be determined. The result is the creation of a position signal by LVDT 123 based on the position of rod 50*a* relative to housing sleeve 114*a*. As discussed in previous FIGS., by detecting the location of rod 50 relative to sleeve 114*a*, a pumped volume and other performance indicators can be calculated.

Figure 11:
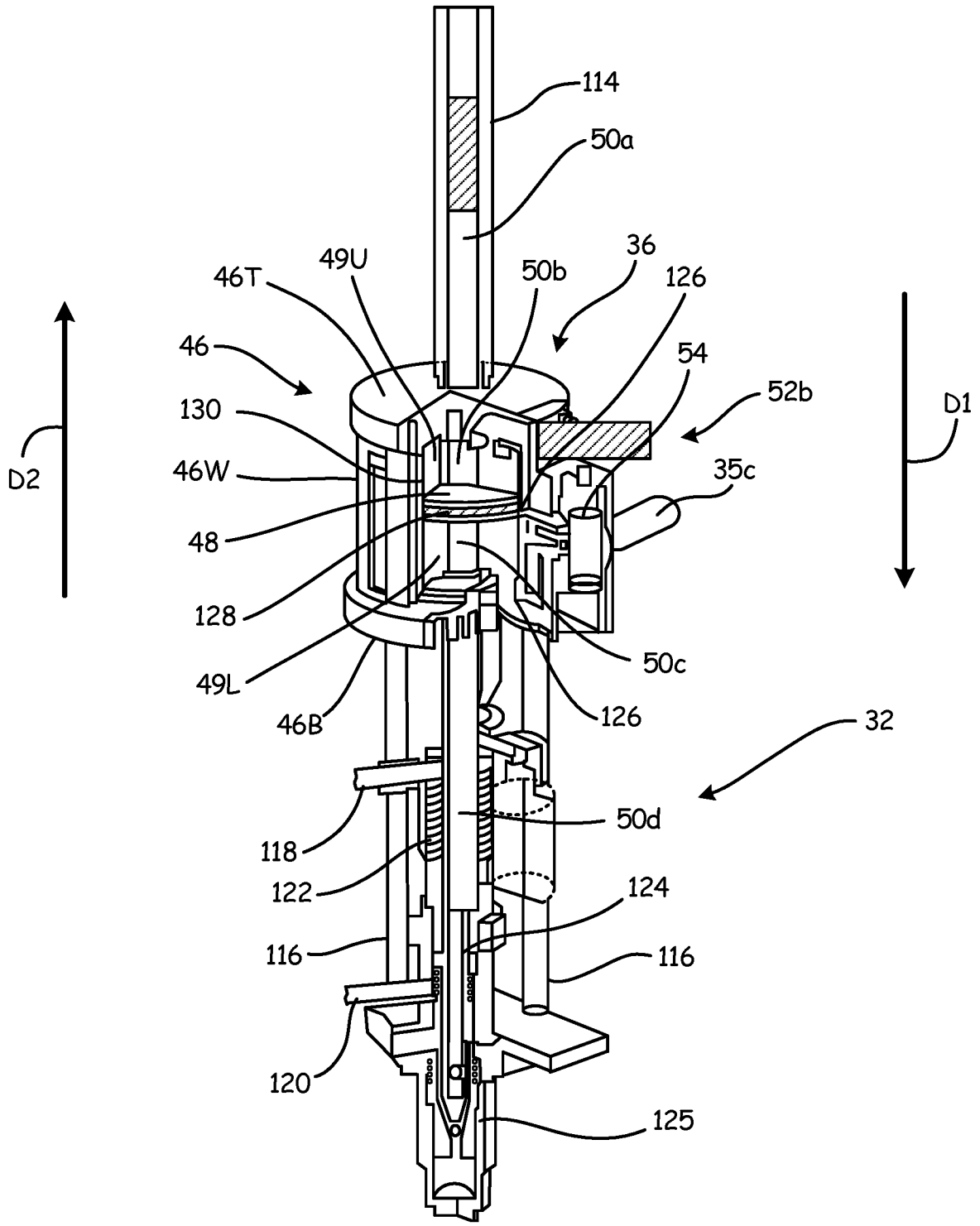
FIG. 11 is a partial cross sectional view of a pump system.

FIG. 11 is a partial cross sectional view of pump 32 and air motor 36 of system 10. FIG. 11 also includes position sensor 52*b*, and sleeve 114*b*. Pump 32 includes rod 50*d*, supports 116, inlet 118, outlet 120, seal 122, pump piston 124, and pump housing 125. Air motor 36 includes, housing 46, air piston 48, upper chamber 49U, lower chamber 49L, rods 50*a*-50*c*, air control valve 54, porting 126, seal 128, and air cylinder 130. Housing 46 includes housing top 46T, housing bottom 46B, and housing sidewall 46W. Also shown in FIG. 11 are directions D1 and D2. Elements of FIG. 11 that are similar to elements of FIGS. 9 and 10 are identified by similar character reference numbers.

The components of FIG. 11 are connected similarly with the components of FIG. 9. However, in FIG. 11, position sensor 52*b* is attached to housing 46 and sleeve 114*b* is closed on the end away from air motor 36. Position sensor 52*b* is securely fastened to housing wall 46W and partially penetrates housing 46. Position sensor 52*b* includes a device for detecting the end of a stroke of air piston 48, for example a reed switch.

In operation of one embodiment, air piston 48 will reciprocate within pump housing 46. Position sensor 52*b* will detect when air piston 48 reaches the top or end of its stroke and create a binary or analog signal based on this detection. In effect, position sensor 52 produces a signal that can be used to count the number of reciprocations made by air piston 48.

Because motor pump 32 is a positive displacement or constant volume pump, each reciprocation of air piston 48, which equates to a full cycle of pump 32, delivers a constant volume of fluid from pump 32. Therefore, by counting the number of reciprocations made by air piston 48 and pump piston 124, a pumped volume and flow rate can be calculated by controller 18.

In this embodiment, sleeve 114*b* is not required for position sensor 52*b* to operate effectively. However, sleeve 114*b* provides additional benefits. Rod 50*c* is necessary to connect air motor 36 to pump 32. As a consequence, rod 50*c* displaces some volume of lower chamber 49L. In the prior art, where rod an upper rod is not used, an upper chamber and a lower chamber will have different volumes during a stroke or cycle.

By adding rod 50*b*, the volume of upper chamber 49U becomes the same as lower chamber 49L during a stroke or cycle of air piston 48. Because rod 50*b* is added to air motor 36, so must sleeve 114*b* be added to allow rod 50*b* to reciprocate freely with the reciprocation of air piston 48. The results is that air piston 48 is acted upon by equivalent volumes of compressed air on either side of air piston 48, which results in a constant force and speed transmitted to pump 32 by air motor 36 during either stroke of air piston 48. This configuration is sometimes referred to as a double ended air motor. By using this type of air motor for air motor 36, the volumes pumped by pump 32 can be more accurately calculated, which saves time and money.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method for pumping, tracking, and controlling a fluid, the method comprising:
- producing a drive signal for driving a motor of a pump using a controller;
- driving the motor to pump a fluid based on the drive signal;
- sending a dispense signal from the controller to a sprayer for dispensing the fluid;
- determining a work piece count as a function of a work piece signal provided to the controller from the work piece sensor;
- detecting the position of a rod connected to the motor and the pump using a position sensor;
- creating a position signal as a function of the position of the rod using the position sensor;
- sending the position signal to the controller;
- receiving a programmed dispenser output from a user interface;
- producing a drive signal for driving the motor;
- producing a dispense signal for the dispenser that is a function of the work piece signal;
- producing a calculated work piece count as a function of the work piece signal;
- determining a volume usage as a function of the position of the rod using the controller;
- producing a calculated flow rate as a function of the calculated volume usage;
- producing a calculated fluid weight as a function of he calculated volume usage; and
- producing a calculated fluid compressibility as a function of the calculated volume usage.

2. The method of claim 1 and further comprising:
- sending a dispense signal from the controller to a plurality of sprayers;
- adjusting the dispense signal of a first sprayer;
- and
- determining sprayer performance of the first sprayer as a function of a change of the flow rate and the adjustment to the dispense signal of the first sprayer.

3. The method of claim 2 and further comprising:
- adjusting a pump speed as a function of the sprayer performance; and
- adjusting the dispense signal as a function of the sprayer performance.

4. The method of claim 1 and further comprising:
- adjusting the drive signal and the dispense signal as a function of the volume usage to meet the programmed dispenser output.

5. The method of claim 1 and further comprising:
- displaying a real-time value of flow rate on the user interface.

6. The method of claim 1 and further comprising:
- determining an average flow rate as a function of the flowrate; and
- displaying a real-time value of the average flow rate on the user interface.

7. The method of claim 1 and further comprising:
- producing an alarm as a function of the flow rate when the flow rate has changed by a prescribed amount, is under a prescribed minimum value, or is above a prescribed maximum value.

8. The method of claim 1 and further comprising:
producing a per-work piece fluid output as a function of the work piece count and the flow rate.

9. The method of claim 8 and further comprising:
displaying a real-time value of the per-work piece fluid output on the user interface.

10. The method of claim 8 and further comprising:
producing an alarm as a function of the per-work piece fluid output when the per-work piece fluid output has changed by a prescribed amount, is over a prescribed minimum value, or is above a prescribed maximum value.

11. The method of claim 1 and further comprising:
producing a long-term fluid output per work piece as a function the work piece count and the flow rate.

12. The method of claim 11 and further comprising:
producing a trend as a function of the long-term fluid output per work piece.

13. The method of claim 11 and further comprising:
uploading data of the trend of long-term fluid output per work piece to a computer readable storage media.

14. The method of claim 11 and further comprising:
displaying a real-time value of the long-term fluid output per work piece on the user interface.

15. The method of claim 11 and further comprising:
producing an alarm as a function of long-term fluid output per work piece when the long-term fluid output per work piece has changed by a prescribed amount, is over a prescribed minimum value, or is above a prescribed maximum value.

16. The method of claim 1 and further comprising:
producing an average fluid output as a function of the flow rate.

17. The method of claim 1 and further comprising:
producing a dispensed fluid output as a function the flow rate and the dispense signal.

18. A method for pumping, tracking and controlling a fluid, the method comprising:
producing a drive signal for driving a motor of a pump using a controller;
driving the motor to pump a fluid based on the drive signal;
sending a dispense signal from the controller to a sprayer for dispensing the fluid;
determining a work piece count as a function of a work piece signal provided to the controller from the work piece sensor;
detecting the position of a rod connected to the motor and the pump using a position sensor;
creating a position signal as a function of the position of the rod using the position sensor;
sending the position signal to the controller;
determining a volume usage as a function of the position of the rod; and
determining a flow rate as a function of the volume usage;
wherein the controller comprises a calculating circuit and computer readable storage media and is configured to:
receive a programmed dispenser output from a user interface;
produce a drive signal for driving the motor;
produce a work piece signal that is a function of detection of a work piece by the work piece sensor;
produce a dispense signal for the dispenser that is a function of the work piece signal;
produce a work piece count as a function of the work piece signal;
produce a volume usage as a function of the position signal;
produce a fluid weight usage as a function of the volume usage; and
produce a fluid compressibility as a function of the volume usage.

* * * * *